US007083058B2

(12) United States Patent
Perry et al.

(10) Patent No.: US 7,083,058 B2
(45) Date of Patent: Aug. 1, 2006

(54) LINERLESS SEALING CLOSURE FOR A CONTAINER

(75) Inventors: James P. Perry, Gahanna, OH (US); Thomas D. Loughrin, Columbus, OH (US); William J. Hook, Westerville, OH (US); Peter Carter, Maineville, OH (US)

(73) Assignee: Abbott Laboratories, Abbott Park, IL (US)

( * ) Notice: Subject to any disclaimer, the term of this patent is extended or adjusted under 35 U.S.C. 154(b) by 100 days.

(21) Appl. No.: 10/248,616

(22) Filed: Jan. 31, 2003

(65) Prior Publication Data

US 2004/0149675 A1 Aug. 5, 2004

(51) Int. Cl.
*B65D 17/44* (2006.01)

(52) U.S. Cl. ..... 215/228; 215/351

(58) Field of Classification Search ..... 215/228, 215/351, 344, 343, DIG. 1; 220/278; 222/83
See application file for complete search history.

(56) References Cited

U.S. PATENT DOCUMENTS

| | | | | |
|---|---|---|---|---|
| 747,461 | A | | 12/1903 | Millett |
| 1,625,963 | A | | 4/1927 | Snyder |
| 1,854,451 | A | | 12/1928 | Cooney |
| 1,712,977 | A | | 5/1929 | Bohnhardt |
| 1,786,802 | A | | 12/1930 | Wamelink |
| 2,014,093 | A | | 9/1935 | Terrill |
| 2,308,126 | A | | 1/1943 | Stover et al. |
| 2,348,014 | A | | 5/1944 | Mallard |
| 2,364,678 | A | | 12/1944 | White |
| 2,633,264 | A | | 3/1953 | Dinsmore et al. |
| 2,731,165 | A | | 1/1956 | Hohl |
| 3,286,868 | A | | 10/1965 | Mumford |
| 3,435,976 | A | | 4/1969 | Owens |
| 3,589,545 | A | | 6/1971 | Carpenter et al. |
| 3,701,452 | A | | 10/1972 | Tonn |
| 3,891,118 | A | | 6/1975 | Laurizio |
| 4,069,937 | A | * | 1/1978 | Smalley ..... 215/344 |
| 4,089,463 | A | | 5/1978 | Babiol |
| 4,253,581 | A | | 3/1981 | Aichinger et al. |
| 4,402,416 | A | | 9/1983 | Mumford et al. |
| 4,549,667 | A | * | 10/1985 | Dullabaun ..... 215/252 |
| 4,616,759 | A | | 10/1986 | Mahler |
| 4,821,899 | A | | 4/1989 | Nycz et al. |
| 4,936,483 | A | | 6/1990 | Ballu |
| 4,957,211 | A | | 9/1990 | Ekkert et al. |
| 4,993,569 | A | | 2/1991 | Osip et al. |
| 5,259,522 | A | * | 11/1993 | Morton ..... 215/344 |

(Continued)

FOREIGN PATENT DOCUMENTS

| | | |
|---|---|---|
| DE | 2 160 798 | 6/1973 |

(Continued)

OTHER PUBLICATIONS

Copy of the PCT Search Report.

*Primary Examiner*—Jacob K. Ackun
*Assistant Examiner*—J Williams
(74) *Attorney, Agent, or Firm*—David L. Weinstein

(57) ABSTRACT

15A sealing closure for use with a container includes a top wall, an annular skirt, and a resiliently flexible annular flange. The annular skirt extends downwardly from the top wall. The annular flange extends downwardly from the top wall and radially outwardly toward the annular skirt. One or more stop ribs can be provided extending downwardly from the top wall and radially inwardly from the annular skirt to limit upward deflection of the annular flange.

21 Claims, 4 Drawing Sheets

U.S. PATENT DOCUMENTS

| | | | | |
|---|---|---|---|---|
| 5,275,287 | A * | 1/1994 | Thompson | 215/344 |
| 5,297,688 | A | 3/1994 | Beck et al. | |
| 5,337,912 | A | 8/1994 | Jochem | |
| 5,374,121 | A | 12/1994 | Draenert | |
| 5,458,854 | A | 10/1995 | Burns | |
| 5,487,481 | A | 1/1996 | Sander et al. | |
| 5,498,333 | A | 3/1996 | Canther | |
| 5,611,446 | A * | 3/1997 | Ingram et al. | 215/252 |
| 5,680,945 | A | 10/1997 | Sander et al. | |
| 5,941,422 | A | 8/1999 | Struble | |
| 6,021,912 | A * | 2/2000 | Hertrampf | 215/344 |
| 6,024,234 | A | 2/2000 | Rink et al. | |
| 6,209,762 | B1 | 4/2001 | Haffner et al. | |
| 6,276,543 | B1 | 8/2001 | German et al. | |
| 6,371,319 | B1 | 4/2002 | Yeaton et al. | |
| 6,488,165 | B1 * | 12/2002 | Hidding | 215/344 |
| 6,581,792 | B1 * | 6/2003 | Limanjaya | 215/252 |
| 2003/0121877 | A1 * | 7/2003 | Brozell et al. | 215/220 |

FOREIGN PATENT DOCUMENTS

| | | |
|---|---|---|
| DE | 42 26 935 | 2/1994 |
| EP | 0 146 011 | 11/1984 |
| FR | 000845166 A | 8/1939 |
| GB | 1 489 287 | 10/1977 |
| GB | 2 022 064 | 5/1979 |
| GB | 2 235 186 | 9/1989 |
| GB | 2 222 821 | 3/1990 |
| WO | 2001/069666 | 8/2004 |

* cited by examiner

FIG. 3
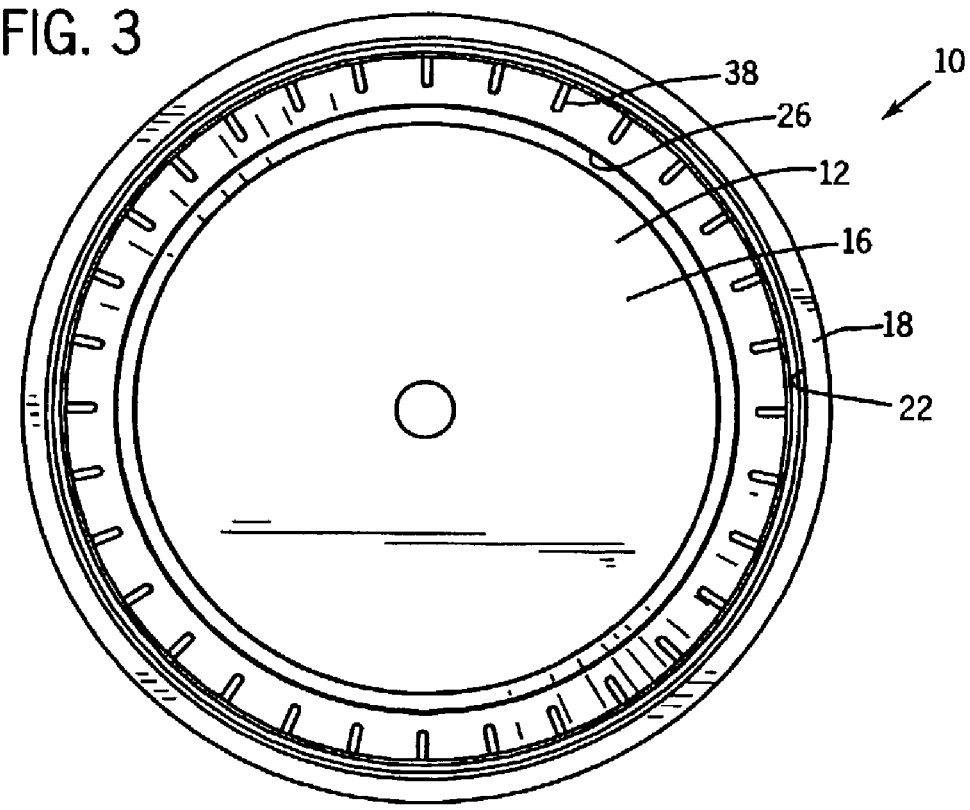
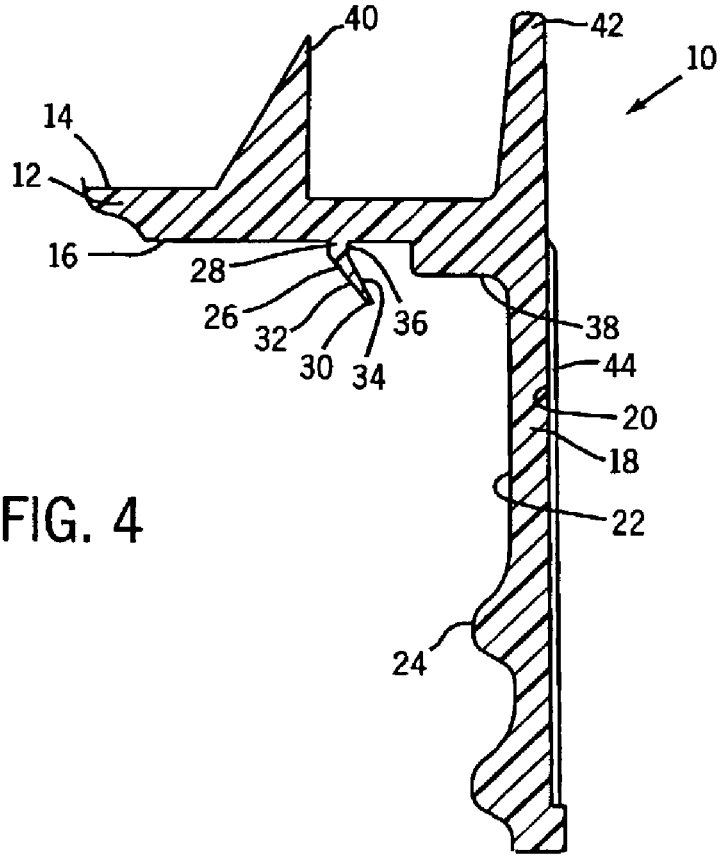
FIG. 4

LINERLESS SEALING CLOSURE FOR A CONTAINER

BACKGROUND OF INVENTION

The present invention relates to closures or caps used to close containers. More particularly, this invention relates to an improved closure or cap for sealing a container aseptically filled with a liquid nutritional product, such as infant formula for example. Whether or not the container is equipped with a metal foil membrane seal hermetically covering the container opening, the present invention provides a linerless cap for sealing the container. Advantageously, the cap of this invention can be used to securely reseal a foil membrane sealed container after the membrane has been punctured. The need for a separate liner installed in the cap is eliminated.

Closures or caps are often utilized to close the mouth or opening of a container. It is sometimes desirable that these closures be capable of repeatedly sealing the container. Prior art closures have included the following features: a sealing member positioned inside the container opening, use of a separate foam liner, and an inflexible or permanently deformable sealing member. All of these features contain certain shortcomings.

Closures having a sealing member positioned inside the opening of a container are undesirable where a container has been initially closed with a membrane seal. The membrane-sealed container is usually shipped with a closure fastened over the membrane. In this case, a closure that seals the container through penetration within the opening of the container is impractical since it would interfere with or damage the membrane seal.

The rim about a container opening will typically have variations in its finish and/or height. When a metal foil membrane is attached in covering relation to the container rim additional variation can result. A separate foam liner installed in the cap is often required to overcome these problems. In this situation a liner is provided between the closure and the container where the closure is insufficient to effectively seal the container by itself. These liners are typically attached to the closure prior to the closure being fastened to the container. The use of a liner is undesirable since it requires increased manufacturing complexity and cost.

Further, an inflexible or permanently deformable sealing member will be unable to accommodate the uneven rim with repeated use. Closures having a sealing member that is inflexible or permanently deformable are unsatisfactory for accommodating manufacturing variations in containers. Closures that are inflexible or permanently deformable may be unable to tolerate finish variations, resulting in an imperfect or failed seal.

Therefore, a principal object of this invention is to provide a sealing closure capable of sealing a container without penetrating an opening in the container.

Another object of the invention is to provide a sealing closure that effectively eliminates the need for a liner to maintain a seal between a container and the sealing closure.

A further object of the invention is to provide a sealing closure capable of sealing a container while accommodating height, finish or other surface variations at the rim of the container.

These and other objects will be apparent to those skilled in the art.

SUMMARY OF INVENTION

A sealing closure for use with a container includes a top wall, an annular skirt, an annular flange, and at least one stop rib. The annular skirt extends downwardly from the top wall. The annular flange extends downwardly from the top wall and radially outwardly toward the annular skirt. The stop rib extends downwardly from the top wall extends radially inwardly between the annular skirt and the annular flange. The stop rib is adapted to abut the rim or a portion of a membrane covering the rim and thereby limits a distance of upward deflection of the annular flange, which contacts the rim or a membrane residing thereon to provide an effective surface area of sealing.

BRIEF DESCRIPTION OF DRAWINGS

FIG. 3 is a bottom view of the device of this invention;

FIG. 4 is a sectional view of the device of this invention taken on line B—B of FIG. 1;

DETAILED DESCRIPTION

Figure 1:
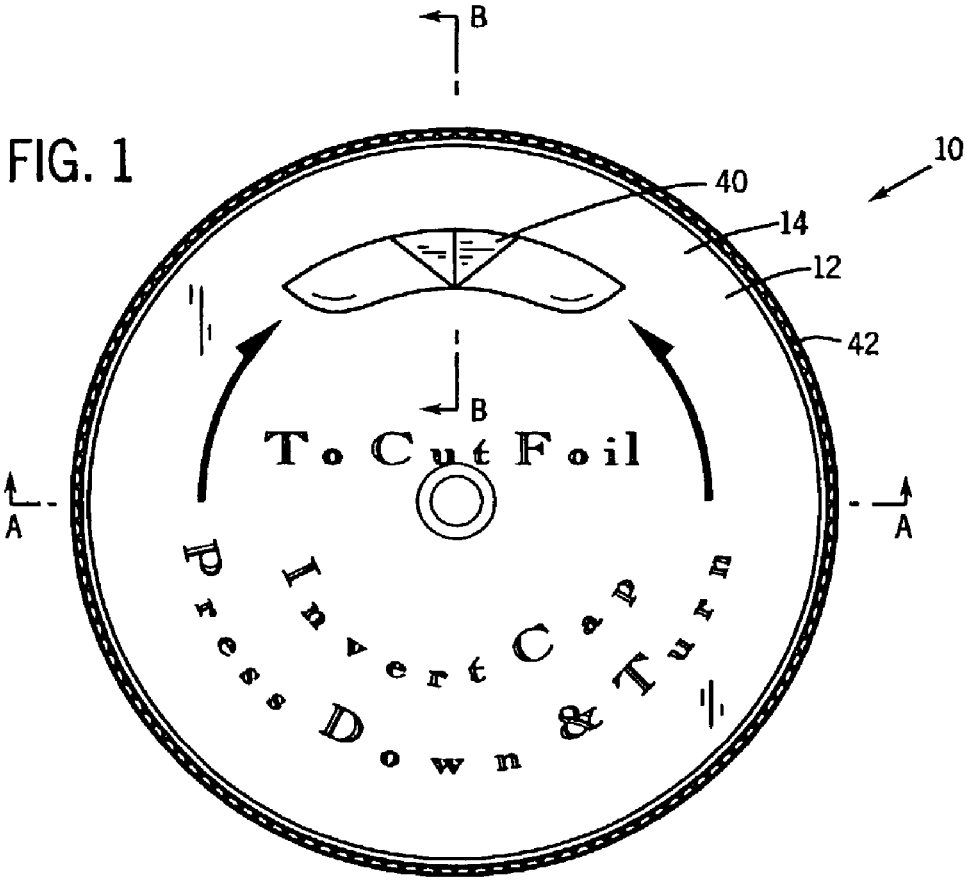
FIG. 1 is a top view of the device of this invention.
Figure 2:
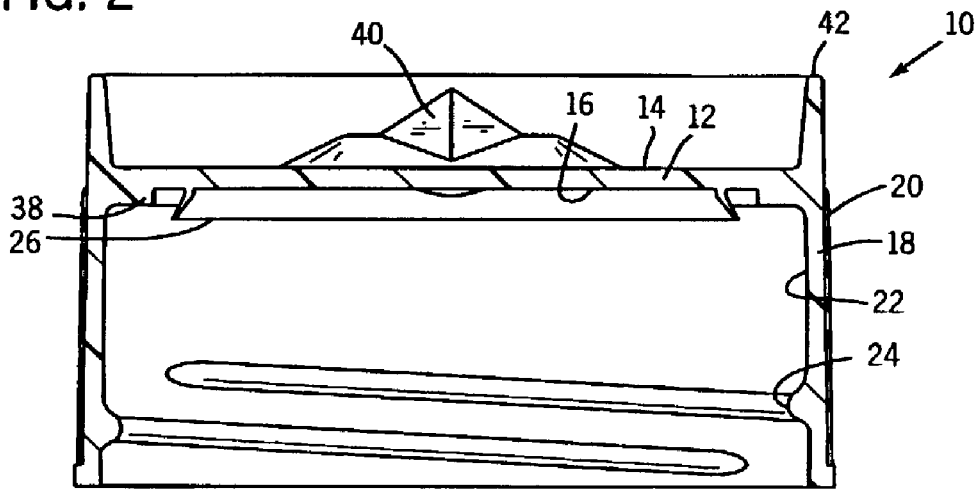
FIG. 2 is a sectional side view of the device of this invention taken on line A—A of FIG. 1.

The sealing closure of this invention is generally shown in FIGS. 1–3. With reference to FIG. 2, a sealing closure 10 for use with a container includes a top wall 12. The top wall 12 has an upper surface 14 and a lower surface 16.

An annular skirt 18 extends downwardly from the top wall 12. The annular skirt 18 has an outer surface 20 and an inner surface 22.

A container engaging element 24 is formed on the inner surface 22 of the annular skirt 18. The container engaging element 24 allows the sealing closure 10 to be removably fastened to a container. The container engaging element 24 is shown as a helical or spiral thread, but it will be understood by one of ordinary skill in the art that other means may be provided for engaging the container without departing from the scope of the present invention.

An annular flange 26 is shown in its preferred form as a single uninterrupted structure. The annular flange 26 extends downwardly from the lower surface 16 of top wall 12 and radially outwardly toward the inner surface 22 of the annular skirt 18.

At least the annular flange is formed of a resilient flexible material. Preferably the whole closure is formed as a single piece of any thermoplastic material conveniently injection molded that has sufficient stiffness to give integrity to threads and sufficient flexibility to the annular flange. More preferably, the closure is formed of a polypropylene homopolymer, polypropylene random copolymer, or a polypropylene impact copolymer with a melt flow rate and flexural modulus as described in the following table:

| Material characteristic | Test Method | Result |
|---|---|---|
| Melt Flow Rate | ASTM D 1238 | 20–65 g/10 minutes |
| Flexural Modulus | ASTM D 790 | 136–223 kpsi |

The material currently most preferred for a closure for a thirty-two ounce container for infant formula is medium impact copolymer PP7684 E2 available from Exxon Mobil Chemical Company.

With reference to FIG. 4, the annular flange 26 includes a base 28 defining an upper end of the annular flange 26 that extends from the lower surface 16, and a tip 30 defining a lower end of the annular flange 26 that extends radially outwardly toward the inner surface 22. Sloped inner and outer surfaces 32 and 34, respectively, extend radially outwardly from the base 28 to the tip 30. The sloped outer surface 34 also defines a bend 36 in the base 28. The bend 36 and the tapered design of the annular flange 26 allow the annular flange 26 to be resiliently flexible and upwardly deflectable.

Stop ribs 38 extend downwardly from the lower surface 16 of the top wall 12 and extend radially inwardly from the inner surface 22 of the annular skirt 18. The stop ribs 38 effectively limit the distance of upward deflection experienced by the annular flange 26. With reference to FIG. 3, the sealing closure 10 shows a plurality of equally spaced stop ribs 38.

With reference to FIG. 2, in one embodiment a piercing member 40 is provided. The piercing member 40 extends upwardly from the upper surface 14 of the top wall 12. The piercing member 40 is provided for the penetration of a membrane seal attached to the rim of a container.

An annular ridge 42 extends upwardly from the upper surface 14 of the top wall 12. The annular ridge 42 has a vertical dimension at least as great as a vertical dimension of the piercing member 40. The annular ridge 42 reduces the likelihood of injury to a user or damage to surrounding objects from the piercing member 40.

With reference to FIG. 4, in another embodiment, a plurality of vertically elongated raised grips 44 are provided. The raised grips 44 extend radially outwardly from the outer surface 20 of the annular skirt 18. The raised grips 44 make it easier for a user to grip the sealing closure 10 and remove it from a container.

Figure 5:
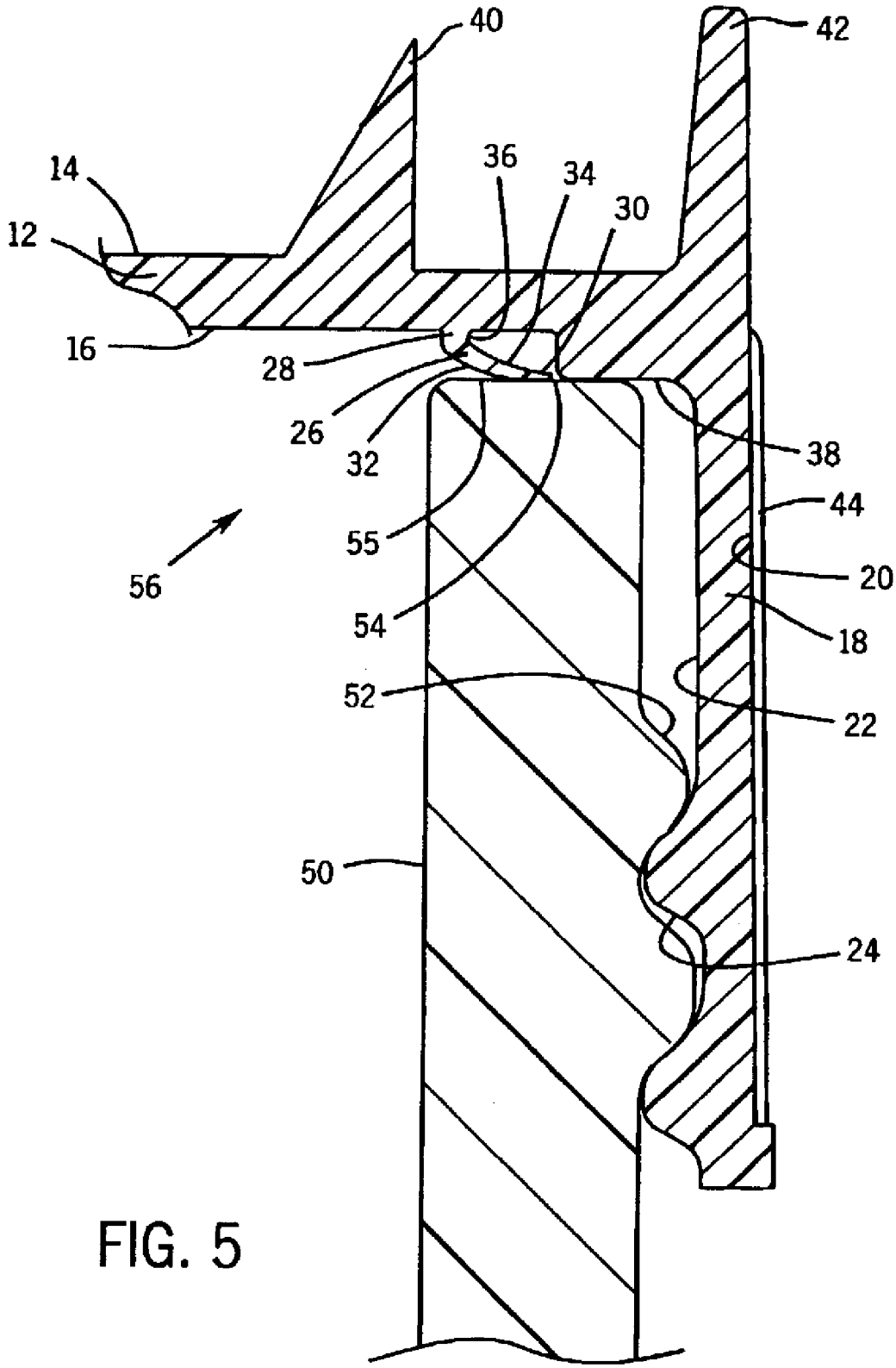
FIG. 5 is a sectional view of the device of this invention taken on line B—B of FIG. 1, where the device has been associated with a container.

With reference to FIG. 5, in use, the sealing closure 10 of the present invention is fastened to a container 50. The container 50 includes closure engaging element 52 for removably mating to the container engaging element 24 of sealing closure 10. A rim 54, having an upper surface 55, extends from the top of the container 50 and defines an opening 56 to the container 50.

As the sealing closure 10 is fastened to the container 50, the tip 30 of the annular flange 26 engages the upper surface 55 of the rim 54. As the sealing closure 10 is fully tightened, the rim 54 directly abuts stop ribs 38 and the inner surface 32 of the annular flange 26 seals against the rim 54 when the flange 26 flexes and deflects upwardly.

The upper surface 55 of the rim 54 often has an uneven finish and surface height variations. Due to these factors, the annular flange 26 flexes and is upwardly deflected a given distance depending on the variations. The highest portions of the uneven upper surface 55 will be engaged by the stop ribs 38 and will deflect the annular flange 26 to the maximum extent. The lowest portions of the uneven upper surface 55 will deflect the annular flange 26 to a lesser extent. The inner surface 32 of the annular flange 26 will provide an effective annular surface seal of a substantial width about the entire circumference of the uneven upper surface 55 due to the flexibility of the annular flange 26.

It is therefore seen that the present invention provides a sealing closure 10 that overcomes the failures of the prior art.

Figure 6:
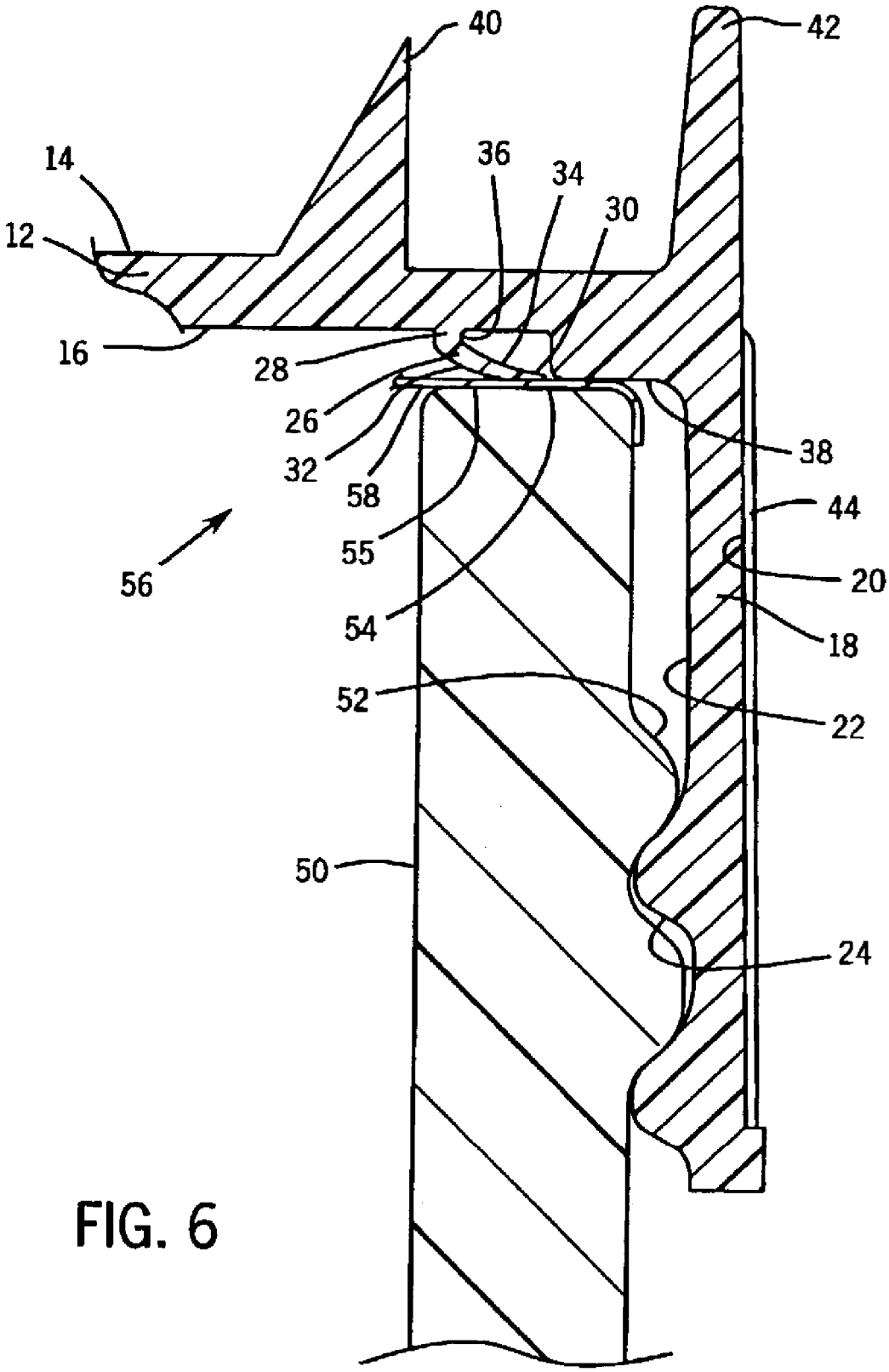
FIG. 6 is a sectional view similar to FIG. 5 but shows an embodiment of the invention wherein a membrane has been attached to the rim of the container.

As seen in FIG. 6, a metal foil membrane 58 is often supplied over the opening 56 to hermetically seal the container 50. The membrane 58 has an upper surface 60. Accordingly, the annular flange 26 is preferably located outside the opening 56 of the container 50, and more preferably registered with the upper surface 55 of the rim 54, so as to not interfere with the membrane 58 or penetrate the opening 56. This design allows the sealing closure 10 to be installed on a membrane sealed container 50 without damaging the membrane 58. To initially access the contents of the container 50, the user typically removes the central portion of the membrane 58 by removing and inverting the closure 10, placing it on the rim 54, pressing down so the piercing member 40 punctures the membrane 58, and then turning the closure 10 approximately three hundred and sixty degrees about its vertical axis. An annular outer ring portion of the membrane 58 remains attached to the rim 54 of the container as shown and extends over the upper surface 55. The closure 10 of this invention allows the container 50 to be repeatedly sealed and stored if all of the contents are not consumed at one time, even where a membrane seal 58 has initially been provided.

As mentioned earlier, the uneven finish or height of the upper surfaces 55 and 60 create difficulties when attempts are made to seal to the rim 54. Prior art closures often require a liner or multiple sealing flanges to overcome this problem. The present invention avoids such additional complexity and cost. It should also be noted that an inflexible or permanently deformable sealing member would be unable to accommodate the surface variations, especially with repeated use. Accordingly, the sealing closure 10 provides an annular flange 26 that is very flexible and may be repeatedly flexed and/or deflected by the rim 54 without permanent deformation; as well as an annular flange 26 capable of being the only element sealing the rim 54 to the sealing closure 10.

Specifically, the annular flange 26 is very flexible due to the sloped inner and outer surfaces 32 and 34, as well as the bend 36 in the base 28. These features reduce the rigidity of the annular flange 26 while providing sufficient durability to withstand repeated deflection.

In addition to being very flexible and resilient, the annular flange 26 is protected from permanent deformation by the stop ribs 38. The stop ribs 38 are adapted to contact the rim 54 (or membrane 58 attached thereto) to limit a distance of upward deflection of the annular flange 26. The vertical dimension of the annular flange 26 and the stop ribs are sized so that the distance of upward deflection of the annular flange 26 is no greater than 0.03 inches. This limit on the distance of upward deflection allows the annular flange 26 to be very flexible, while at the same time limiting the risk of permanent deformation.

It is therefore seen that the present invention provides a sealing closure capable of repeatedly sealing a container without penetrating an opening in the container. The present invention further provides a sealing closure that effectively eliminates the need for a liner to maintain a seal between a container and the sealing closure. The present invention also provides a sealing closure capable of sealing a container while accommodating finish or height variations in a rim of the container.

It is therefore seen that this invention will accomplish at least all of its stated objectives.

The invention claimed is:

1. A sealing closure for use with a container having a rim defining an opening, comprising: a top wall having a lower surface and an upper surface;

an annular skirt extending downwardly from the top wall, including a container engaging means on an inner surface thereof adapted to releasably draw the sealing closure into engagement with the container;

an annular flange extending downwardly from the lower surface of the top wall and radially outwardly toward the annular skirt, wherein the annular flange is resiliently flexible and upwardly deflectable and is adapted to engage an upper surface of the rim so as to provide an annular surface seal for the opening of the container; and at least one stop rib extending downwardly from the lower surface and extending radially inwardly from the annular skirt, the stop rib being adapted to contact the rim to limit a distance of upward deflection of the annular flange, the annular flange positioned so that it is located outside of the opening of the container, whereby the sealing closure can be installed on a container having a sealing membrane without damaging the sealing membrane.

2. The sealing closure of claim 1, wherein the at least one stop rib comprises a plurality of equally spaced stop ribs.

3. The sealing closure of claim 1, wherein the distance of upward deflection is no greater than 0.03 inch.

4. The sealing closure of claim 1, wherein the annular flange is the only element sealing the rim to the sealing closure.

5. The sealing closure of claim 1, further having a piercing member extending upwardly from the upper surface of the top wall of the sealing closure.

6. The sealing closure of claim 1, wherein the annular flange is a single uninterrupted annular flange.

7. A sealing closure for use with a container having a rim defining an opening, comprising: a top wall having a lower surface and an upper surface;

an annular skirt extending downwardly from the top wall, including a container engaging means on an inner surface thereof adapted to releasably draw the sealing closure into engagement with the container;

an annular flange extending downwardly from the lower surface of the top wall and radially outwardly toward the annular skirt, including sloped inner and outer surfaces extending radially outwardly from the lower surface of the top wall toward the annular skirt, wherein the annular flange is resiliently flexible and upwardly deflectable and is adapted to engage an upper surface of the rim so as to provide an annular surface seal for the opening of the container; and at least one stop rib extending downwardly from the lower surface and extending radially inwardly from the annular skirt, the stop rib being adapted to contact the rim to limit a distance of upward deflection of the annular flange, the annular flange positioned so that it is located outside of the opening of the container, whereby the sealing closure can be installed on a container having a sealing membrane without damaging the sealing membrane.

8. The sealing closure of claim 7, wherein the annular flange is connected to the lower surface by a base and the sloped outer surface defines a bend in the base.

9. The sealing closure of claim 7, wherein the annular flange is the only element sealing the rim to the sealing closure.

10. The sealing closure of claim 7, wherein the at least one stop rib comprises a plurality of equally spaced stop ribs.

11. The sealing closure of claim 7, wherein the distance of upward deflection is no greater than 0.03 inch.

12. The sealing closure of claim 7, further having a piercing member extending upwardly from the upper surface of the top wall of the sealing closure.

13. In combination, a container having a rim defining an opening, and a sealing closure comprising:

a top wall having a lower surface and an upper surface;

an annular skirt extending downwardly from the top wall, including a container engaging means on an inner surface thereof adapted to releasably draw the sealing closure into engagement with the container; and an annular flange extending downwardly from the lower surface of the top wall and radially outwardly toward the annular skirt, wherein the annular flange is resiliently flexible and upwardly deflectable and is adapted to engage an upper surface of the rim so as to provide an annular surface seal, and at least one stop rib extending downwardly from the lower surface and extending radially inwardly from the annular skirt, the stop rib is being adapted to engage the rim to limit a distance of upward deflection of the annular flange, the annular flange positioned so that it is located outside of the opening of the container, whereby the sealing closure can be installed on a container having a sealing membrane without damaging the sealing membrane.

14. The combination of claim 13, wherein the annular flange has sloped inner and outer surfaces that taper toward a tip.

15. The combination of claim 13, wherein the annular flange is connected to the lower surface by a base and the sloped outer surface defines a bend in the base.

16. The combination of claim 13, wherein the annular flange is the only element sealing the rim to the sealing closure.

17. The combination of claim 13, wherein the annular flange is arranged to overlap the upper surface of the rim.

18. The combination of claim 13, wherein the annular flange is a single uninterrupted structure.

19. The combination of claim 13, wherein the at least one stop rib comprises a plurality of equally spaced stop ribs.

20. The combination of claim 13, wherein the at least one stop rib and the annular flange are vertically spaced apart such that the annular flange can deflect upwardly up to 0.03 inch.

21. The combination of claim 13, wherein the sealing closure further has a piercing member extending upwardly from the upper surface of the top wall of the sealing closure.

* * * * *